US009770625B1

(12) United States Patent
LaFore et al.

(10) Patent No.: US 9,770,625 B1
(45) Date of Patent: Sep. 26, 2017

(54) GAFF GUARD

(71) Applicant: SHERRILL, INC., Greensboro, NC (US)

(72) Inventors: Scott LaFore, Belleville, IL (US); Casey Selner, Green Bay, WI (US)

(73) Assignee: Sherrill, Inc., Greensboro, NC (US)

( * ) Notice: Subject to any disclaimer, the term of this patent is extended or adjusted under 35 U.S.C. 154(b) by 0 days.

(21) Appl. No.: 15/208,765

(22) Filed: Jul. 13, 2016

(51) Int. Cl.
*A63B 27/02* (2006.01)
*A63B 27/00* (2006.01)

(52) U.S. Cl.
CPC ..... *A63B 27/02* (2013.01); *A63B 27/00* (2013.01)

(58) Field of Classification Search
CPC ..... A63B 27/02; A63B 27/04; A63B 27/00
USPC ..... 182/221; 30/151
See application file for complete search history.

(56) References Cited

U.S. PATENT DOCUMENTS 1,774,615 A 9/1930 Rose
1,931,823 A * 10/1933 Hushour ..... A63B 27/02 182/221
1,981,755 A 11/1934 Serene
2,296,074 A 9/1942 Weed et al.
2,419,363 A 4/1947 Minney
2,497,710 A * 2/1950 Wollensack ..... A63B 27/02 182/221
2,808,974 A 10/1957 Bessinger
2,859,516 A * 11/1958 McQueary ..... B26B 29/025 224/197
2,870,947 A * 1/1959 Hendry ..... A63B 27/02 182/221
3,135,352 A 6/1964 Hutchings
3,546,777 A * 12/1970 Katsuji ..... B26B 13/24 30/151
3,640,358 A 2/1972 Smith
3,977,077 A * 8/1976 Rebold ..... B26B 1/00 30/151
4,282,951 A * 8/1981 Zelins ..... A63B 27/02 182/134
4,989,693 A * 2/1991 Williams ..... A63B 27/02 182/134
4,998,350 A * 3/1991 Thompson ..... B26B 29/025 224/232
5,080,194 A * 1/1992 Williams ..... A63B 27/02 182/134
6,148,959 A * 11/2000 Shay ..... A63B 27/02 182/134
7,726,031 B1 * 6/2010 Gibbs ..... B26B 5/00 279/57

(Continued)

*Primary Examiner* — Katherine Mitchell
*Assistant Examiner* — Marcus Menezes
(74) *Attorney, Agent, or Firm* — The Webb Law Firm

(57) ABSTRACT

A gaff guard for use in covering the gaff of a climbing spur, the gaff guard comprising a first section having a first diameter, the first section configured to at least partially surround the gaff, and a second section having a second diameter, the second diameter larger than the first diameter, wherein the second section comprises an elongated opening therein to enable the second section to be removably attached to a portion of the climbing spur. The gaff guard further comprises a tapered section between the first section and the second section, wherein the tapered section couples the first section and the second section, and further wherein the tapered section comprises a cut-out portion configured to allow the climbing spur to pass therethrough.

19 Claims, 8 Drawing Sheets

(56) References Cited

U.S. PATENT DOCUMENTS

2008/0235953 A1* 10/2008 Wang ..... B26B 5/002
30/151

* cited by examiner

GAFF GUARD

BACKGROUND OF THE INVENTION

Field of the Disclosure

The present disclosure relates to a guard device configured to cover and protect a gaff or other elongated, sharpened spike, particularly for use on climbing spurs utilized to ascend and descend wooden poles and/or trees.

Description of Related Art

For many years, arborists (or tree workers) and those in the telephone and electrical utility industries have utilized climbing spurs (also known as "gaffs", "hooks", or "climbers") strapped to their lower legs as an aid to ascending and descending trees, wooden utility poles, etc. Referring to FIG. 1 and FIG. 2, an example of a known climbing spur configuration is illustrated. Spur 100 comprises a leg iron 102 having an inner shank surface 104 and an outer shank surface 106. An upper portion of spur 100 comprises a pad-and-strap arrangement 108, with the pad-and-strap arrangement 108 configured to secure the spur 100 around the user's lower leg at a location below the user's knee. On a lower portion of spur 100 is a stirrup 110, which is bent and proportioned so as to allow a user's foot to fit thereon, preferably at the midsole of the foot. A joining portion 111 of stirrup 110 may be configured to allow stirrup 110 to be affixed to leg iron 102 via, for example, rivets, bolts, welding, etc. Alternatively, stirrup 110 could be co-formed with leg iron 102, or stirrup 110 could be formed of a continuous piece of bent metal. On an outer end of stirrup 110 is a ring loop 112, which allows a split ring joining a boot strap (not shown) to pass therethrough such that the user's boot may be secured to stirrup 110.

Referring still to FIG. 1 and FIG. 2, spur 100 further comprises a gaff 114 mounted on an outer shank surface 106, opposite stirrup 110. As shown in FIG. 2, gaff 114 comprises an upper portion 115 and a lower portion 116. Upper portion 115 is sized and configured to allow gaff 114 to be mounted to leg iron 102 via any appropriate connection means, for example, screws, bolts, rivets, welding, etc. Lower portion 116, on the other hand, is bent so as to extend slightly away from leg iron 102, and lower portion 116 comprises a sharpened point 117 on a distal end thereof, along with at least one sharpened edge 118. In this way, gaff 114 is capable of effectively digging into the wood of a tree or utility pole. Ideally, the user is equipped with a spur 100 on each leg, with each gaff 114 positioned toward the inside of each of the user's legs. With the spur 100 strapped to each leg, the user can utilize the respective gaffs 114 to more easily and safely ascend and descend a tree or utility pole.

For the spurs to operate adequately, the gaffs themselves must be sufficiently sharp so as to easily puncture the wood of a tree or utility pole with little more than the user's body weight applied thereto. However, gaffs sharpened to this level also risk damaging equipment during transport, or, if mishandled, potentially causing injury to a user or others. Accordingly, to prevent injury, prevent equipment damage, and/or preserve the sharpness of the gaffs, workers often install a protective device or sleeve over each gaff when the spurs are not in use. Existing protective devices have included rubber sleeves, spring- or cord-tensioned shields, flexible leather coverings, etc. However, these existing protective devices often lack durability for frequent use, are difficult to install and/or remove from the gaff, and/or must be fixedly mounted to a portion of the spur, even when not in use. Any added complication in installing or removing the protective device increases the user's risk of injury, or, at the very least, dissuades the user from employing the protective device. Additionally, many previous protective devices have involved complicated designs that are both expensive to produce and difficult to maintain. Furthermore, existing protective devices have been prone to disconnect from the gaffs during transport, which increases the likelihood of injury or equipment damage, as the user is under the assumption that the protective devices is correctly installed.

U.S. Pat. No. 4,282,951 discloses one such protective device for a gaff, wherein the protective device is monolithically formed of a synthetic resinous material. The protective device shown and described in U.S. Pat. No. 4,282,951 comprises a frusto-conically shaped sheath configured to fit over a substantial portion of a gaff, along with a clip portion coupled to the frusto-conically shaped sheath via a flexible stem portion. After the sheath is placed around the gaff, the clip is configured to mount to a leg iron portion of the spur, with the flexible stem portion providing a stressed frictional engagement between the protective device and the leg iron, thereby helping to maintain the protective device in position on the gaff.

While the protective device shown and described in U.S. Pat. No. 4,282,951 is monolithically formed and is removable by the user, such removal may be difficult due to the limited size of the clip portion and stressed frictional engagement provided by the flexible stem portion. That is, the user must use his or her fingers to detach clip portion from the leg iron. As the user is often working with gloved hands, the need for such dexterity in removing the protective device is, at the very least, inconvenient.

Furthermore, the frusto-conically shaped sheath, fixed-length flexible stem portion, and fixed-width clip portion limit the size and shape of gaff and leg iron that can be covered by the protective device of U.S. Pat. No. 4,282,951. Gaff lengths and other gaff dimensions may vary dependent upon application and user preference. For instance, an arborist may require a longer gaff than a utility worker, as trees are generally less uniform than utility poles. Specifically, gaffs for use in climbing trees are often at least 2¾ inches in length, while those used on utility poles are generally shorter, e.g., 1½ inches in length. Thus, a protective device such as that shown in U.S. Pat. No. 4,282,951 may provide sufficient coverage for a gaff used by utility workers, but may be too small to provide protection for gaffs commonly used by arborists. Additionally, the clip portion may be sized for one particular width of leg iron, but may not be compatible with other leg irons.

SUMMARY OF THE INVENTION

Accordingly, there is a need for a gaff guard for use on a climbing spur that provides adequate coverage for gaffs and leg irons of varying dimensions. Furthermore, there is also a need for a gaff guard that may be easily installed and/or removed by a user in the field.

In accordance with some aspects of the disclosure, a gaff guard may have a first section having a first diameter, the first section configured to at least partially surround the gaff, and a second section having a second diameter, the second diameter larger than the first diameter, wherein the second section comprises an elongated opening therein to enable the second section to be removably attached to a portion of the climbing spur. The gaff guard may further comprise a tapered section between the first section and the second section, wherein the tapered section couples the first section and the second section, and further wherein the tapered section comprises a cut-out portion configured to allow the climbing spur to pass therethrough.

In accordance with other aspects of the disclosure, at least the first section of the gaff guard may be cylindrical, with the first section, second section, and tapered section being monolithically formed. Each of the first section, second section, and tapered section are preferably formed of a flexible material, such as a thermoplastic polymer. The second section may comprise a pair of end surfaces, wherein the space between the pair of end surfaces forms the elongated opening. Additionally, the second section may comprise a notch formed on a surface opposite the elongated opening to ease the installation and removal of the gaff guard.

In accordance with other aspects of the disclosure, a climbing spur to aid in the ascent and descent of trees or utility poles may be provided, the climbing spur comprising a leg iron having a first end and second end, the leg iron configured to be removably attached to a user's leg at the first end, a stirrup extending from the second end of the leg iron, the stirrup configured to support the user's foot, and a gaff extending from the leg iron opposite the stirrup. Furthermore, the climbing spur may comprise a gaff guard configured to be removably attached to the leg iron, the gaff guard comprising a first section having a first diameter, the first section configured to at least partially surround the gaff, a second section having a second diameter, the second diameter larger than the first diameter, wherein the second section comprises an elongated opening therein to enable the second section to be removably attached to the leg iron, and a tapered section between the first section and the second section, wherein the tapered section couples the first section and the second section, and further wherein the tapered section comprises a cut-out portion configured to allow the leg iron to pass therethrough.

In accordance with additional aspects of the disclosure, a method of installing a gaff guard to cover a gaff of a climbing spur may be provided. The method may comprise providing a gaff guard, with the gaff guard comprising a first section having a first diameter, the first section configured to at least partially surround the gaff, a second section having a second diameter, the second diameter larger than the first diameter, wherein the second section comprises an elongated opening therein to enable the second section to be removably attached to a portion of the climbing spur, and a tapered section between the first section and the second section, wherein the tapered section couples the first section and the second section, and further wherein the tapered section comprises a cut-out portion configured to allow the climbing spur to pass therethrough. The method may further comprise positioning the first section over at least a portion of the gaff, and attaching the second section to the climbing spur through the elongated opening formed in the second section.

These and other features and characteristics of climbing spurs and gaff guards, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only. As used in the specification and the claims, the singular form of "a", "an", and "the" include plural referents unless the context clearly dictates otherwise.

DESCRIPTION OF THE INVENTION

Figure 1:
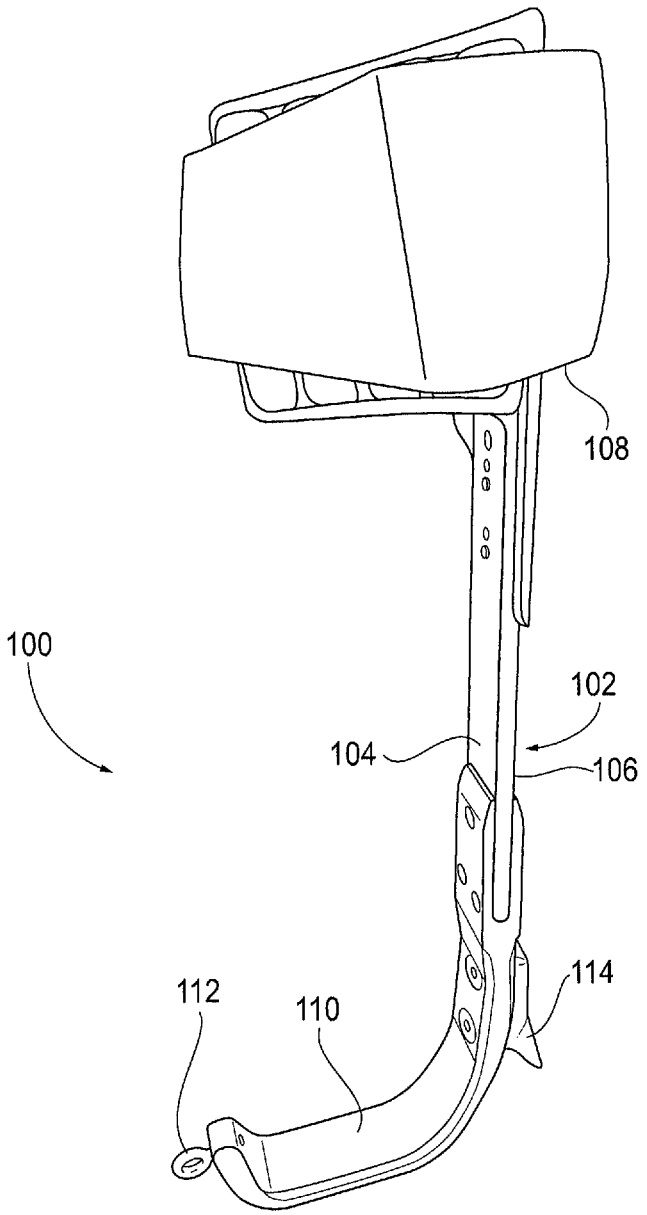
PRIOR ART FIG. 1
FIG. 1 is a front perspective view of a climbing spur according to the prior art.

For the purposes of the description hereinafter, the terms "upper," "lower," "right," "left," "vertical," "horizontal," "top," "bottom" and derivatives and equivalents thereof shall relate to the invention as it is oriented in the drawing figures. However, it is to be understood that the invention may assume various alternate variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

Figure 2:
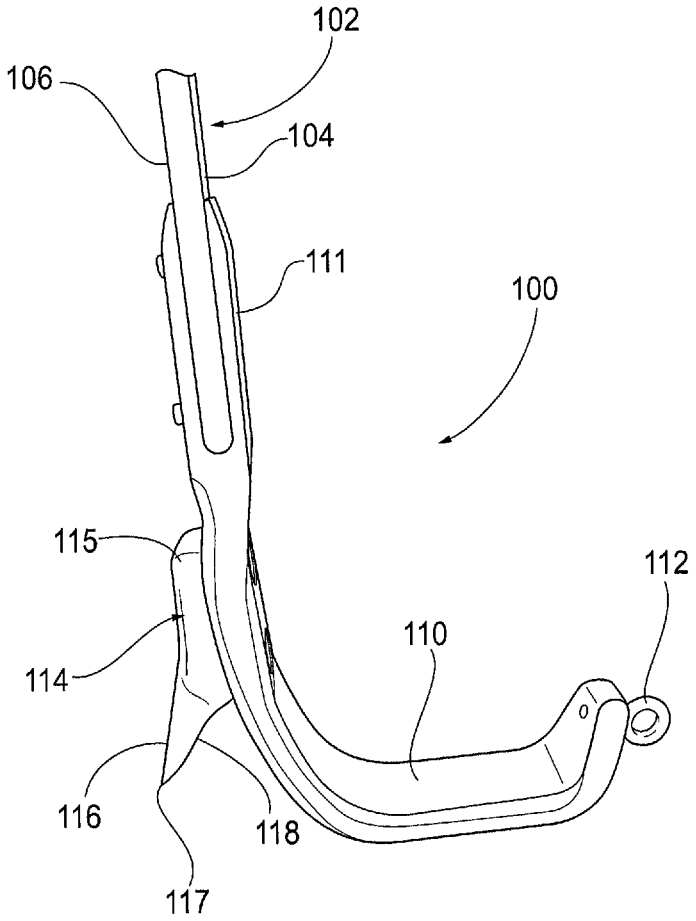
PRIOR ART FIG. 2
FIG. 2 is a side view of the lower portion of the climbing spur of FIG. 1.
Figure 3:
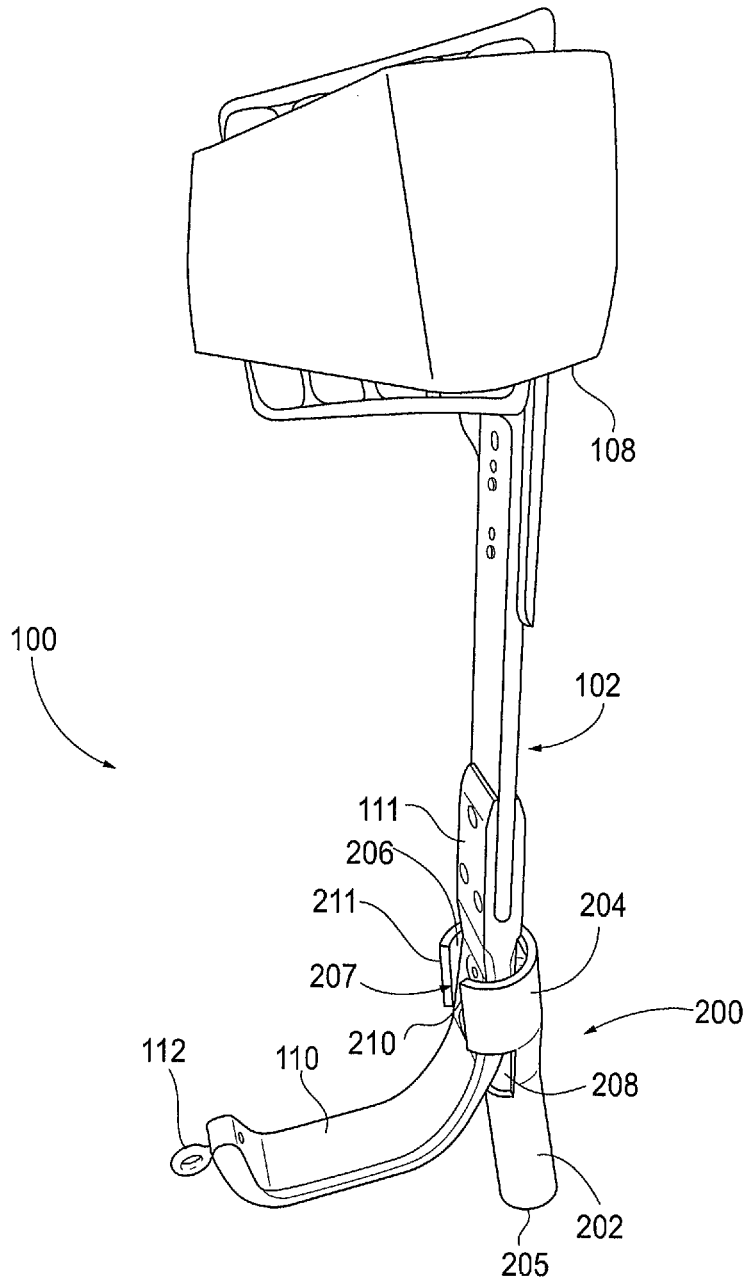
FIG. 3 is a front perspective view of a climbing spur with attached gaff guard according to an aspect of the present disclosure.
Figure 4:
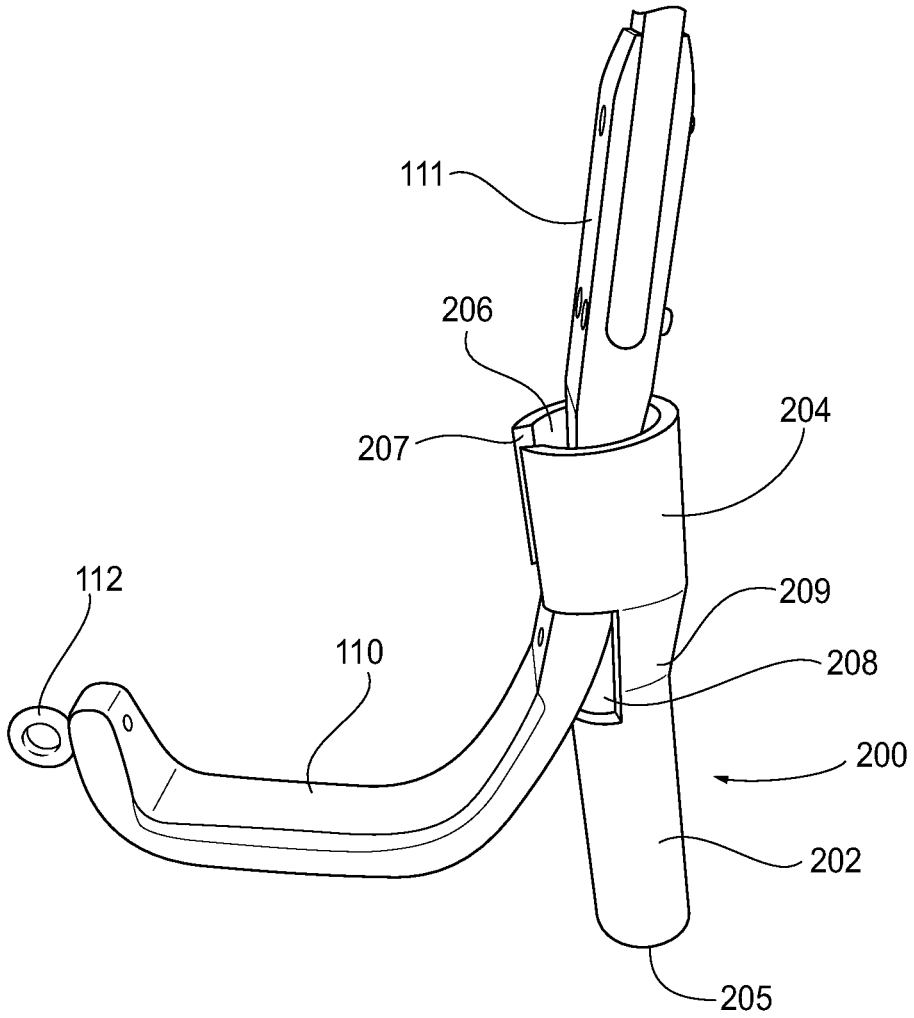
FIG. 4 is a side view of the lower portion of the climbing spur with attached gaff guard of FIG. 3.
Figure 5:
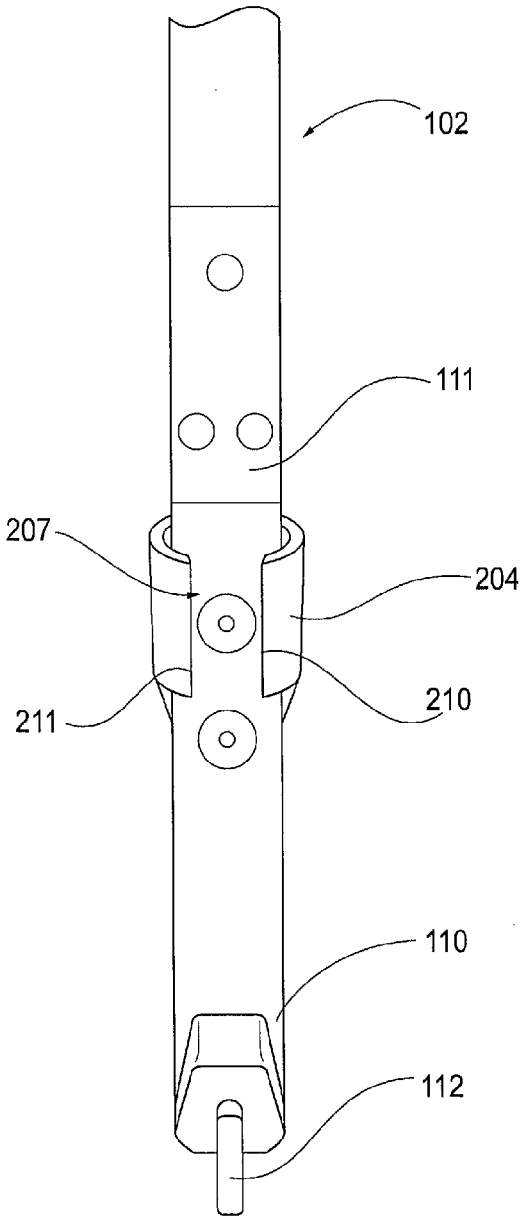
FIG. 5 is a front view of the lower portion of the climbing spur with attached gaff guard of FIG. 3.
Figure 6:
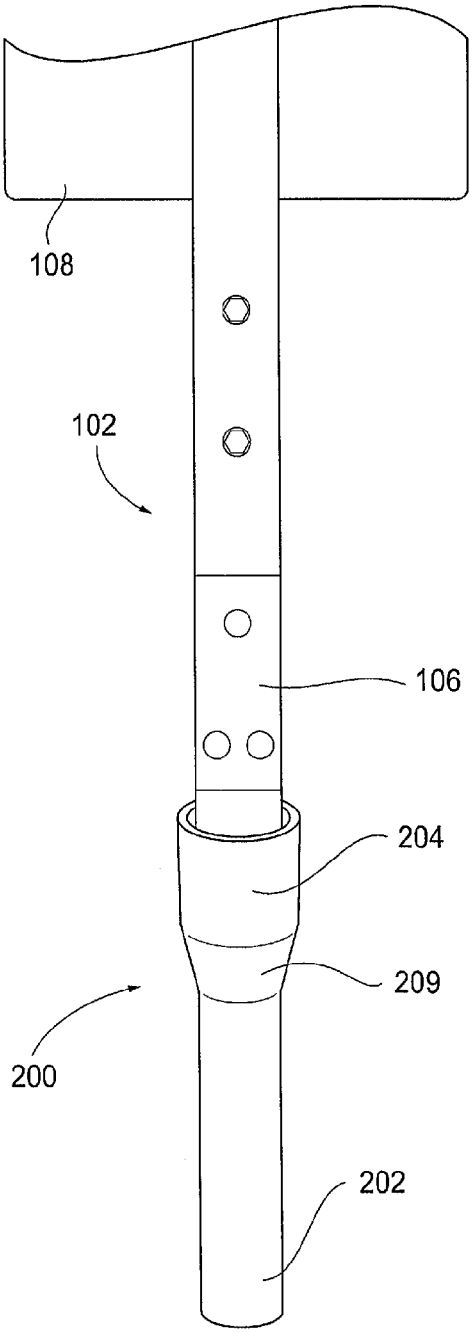
FIG. 6 is a rear view of the lower portion of the climbing spur with attached gaff guard of FIG. 3.

Referring to FIGS. 3-6, various views of a climbing spur having a gaff guard attached thereto according to an aspect of the present disclosure are shown. The features of climbing spur 100 shown and described above with respect to FIGS. 1-2 are similarly shown, with common reference numerals, in FIGS. 3-6. As such, their functions will not be reiterated herein. FIGS. 3-6 show a gaff guard 200 disposed over a gaff 114 affixed to spur 100. Gaff guard 200 comprises a first section 202 and a second section 204. First section 202, as illustrated, is preferably cylindrical in shape such that first section 202, when installed, surrounds a majority of gaff 114, particularly the sharpened surfaces of gaff 114. A first open end 205 is located on distal end of first section 202. First open end 205 enables dirt, debris, moisture, etc. to exit gaff guard 200, thereby reducing the likelihood that gaff 114 is dulled or damaged due to prolonged exposure to such elements when gaff guard 200 is in place. It is to be understood that a pair of gaff guards 200 are to be utilized, with one installed over each gaff 114 of respective spurs 100.

Second section 204 of gaff guard 200 is preferably only partially cylindrical, with a second open end 206 on an end thereof. An opening 207 located on second section 204 enables gaff guard 200 to snap onto leg iron 102 or another portion of spur 100. Opening 207 is sufficiently large so as to allow at least a portion of leg iron 102 to pass therethrough, but not so large as to limit the retention of gaff guard 200 on spur 100 when installed.

When a user wishes to install the gaff guard 200 onto spur 100, the user must first slide first section 202 over gaff 114 via a cut-out section 208 located between the first section 202 and second section 204. When at least the sharpened portions of gaff 114 are sufficiently covered by the first section 202, the user may push and/or twist the second section 204 in the direction of the leg iron 102. This pushing and/or twisting motion of second section 204 allows one of respective end surfaces 210, 211 of second section 204 to snap onto leg iron 102. After one of respective end surfaces 210, 211 is in place around leg iron 102, an additional pushing and/or twisting motion in the opposite direction allows the other of the respective end surfaces 210, 211 to snap onto leg iron 102, thereby attaching gaff guard 200 to spur 100. This attachment of gaff guard 200 may be completed by the user using only one hand. In fact, first section 202 of gaff guard 200 is preferably sized so as to be gripped by one hand of the user.

To detach gaff guard 200 from spur 100, the user must simply reverse the attachment steps described above. That is, when the user wishes to detach gaff guard 200, the user may rotate and/or pull on second section 204 until one of respective end surfaces 210, 211 releases from the leg iron 102. Rotation and/or pulling of second section 204 in an opposite direction then releases second section 204 from the leg iron 102, at which time the user may remove the gaff guard 200 from its protective position over gaff 114 in preparation for use of the spur 100.

As noted above, respective end surfaces 210, 211 of second section 204 must snap onto leg iron 102 in order to attach the gaff guard 200 to spur 100. Gaff guard 200 enables such a snap-on configuration by preferably being formed (in whole or in part) of a resilient, yet at least partially flexible, material. For example, gaff guard 200 may be formed of a thermoplastic polymer material, such as acrylonitrile-butadiene-styrene (ABS). However, any appropriate resilient and at least partially flexible material could be used to form gaff guard 200, such as a flexible plastic (polyamide (PA), polyethylene (PE), etc.), composite, rubber, or metallic material. The flexibility of the material forming second section 204 is key to enabling the second section to be securely snapped onto leg iron 102 of the spur 100 so as to hold gaff guard 200 in place.

Additionally, while first section 202 and second section 204 of gaff guard 200 are shown as cylindrical and partially cylindrical, respectively, it is to be understood that their shapes could vary in accordance with other aspects of the present disclosure. For example, sections 202, 204 could have rectangular (and/or partially rectangular) cross-sections, polygonal (and/or partially polygonal) cross-sections, etc.

Figure 7:
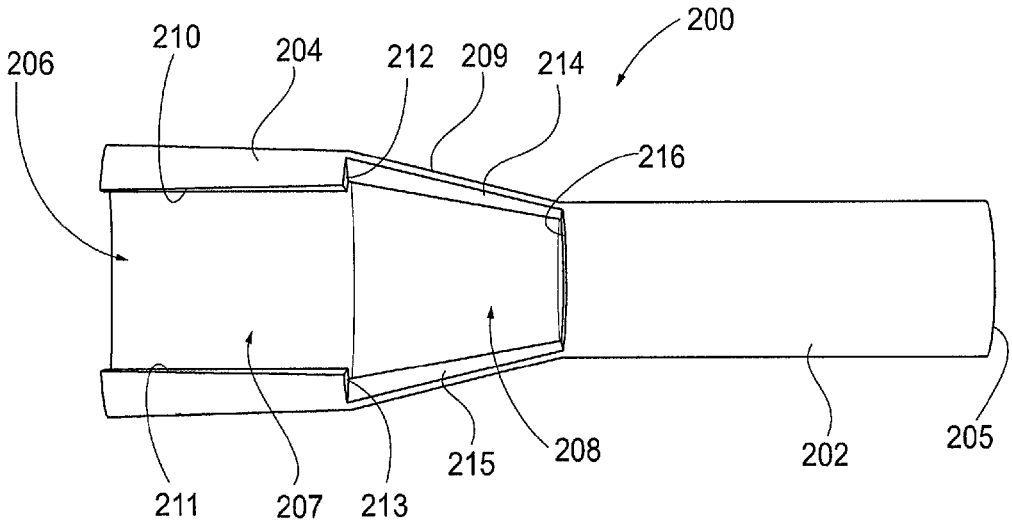
FIG. 7 is a top view of a gaff guard according to an aspect of the present disclosure.
Figure 8:
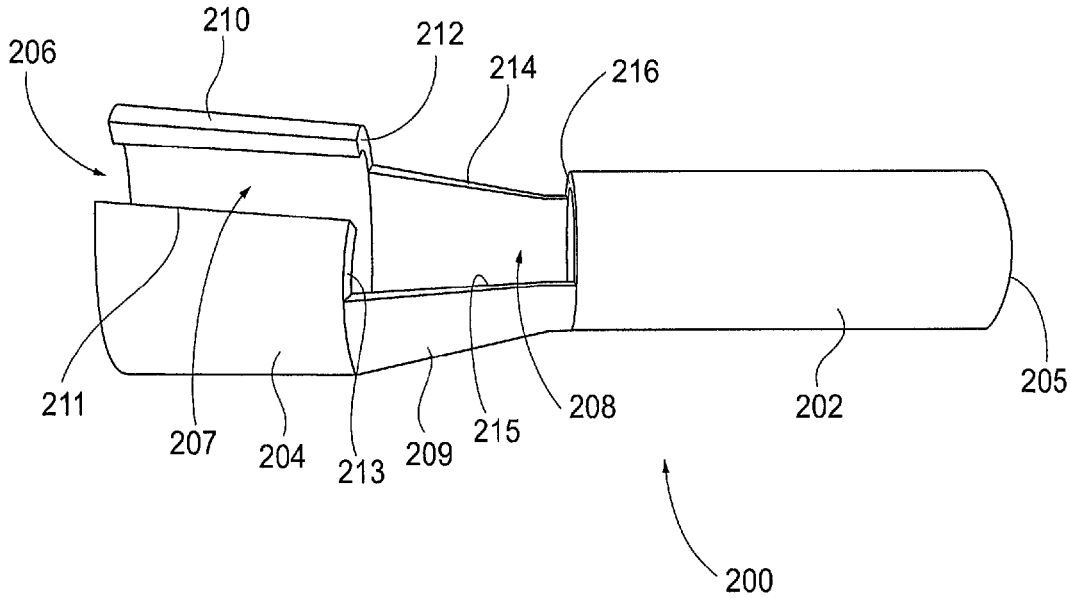
FIG. 8 is a side perspective view of the gaff guard of FIG. 7.
Figure 9:
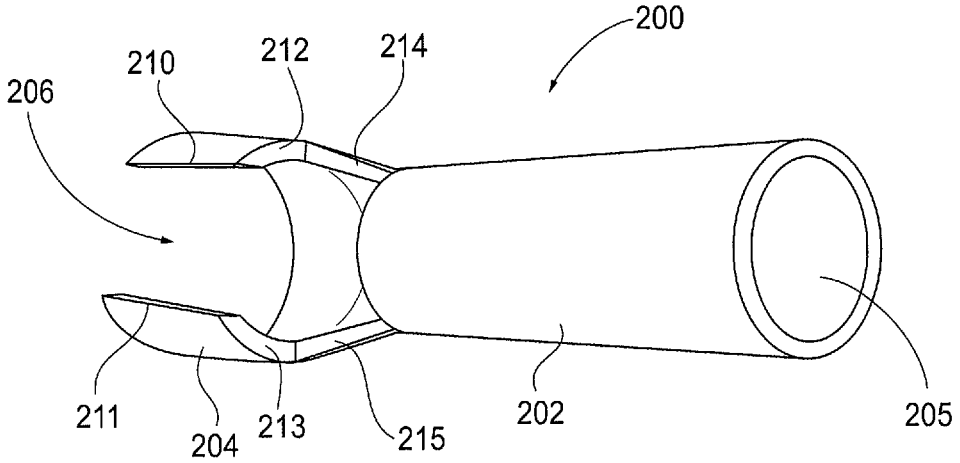
FIG. 9 is an end perspective view of the gaff guard of FIG. 7.

Next, referring to FIGS. 7-9, additional details regarding gaff guard 200 according to an aspect of the present disclosure are shown. As described above with respect to FIGS. 3-6, gaff guard 200 comprises a first section 202 and a second section 204. First section 202 and second section 204 are connected via a tapered section 209, wherein tapered section 209 itself comprises cut-out section 208. First section 202 has a first outer diameter, while second section 204 has a second outer diameter larger than the first outer diameter. Specifically, first section 202 may have a diameter in the range of about 15 mm-25 mm, and ideally about 21 mm. Second section 204 may have a diameter in the range of about 40 mm-50 mm, and ideally about 46.5 mm. These varying outer diameters of first section 202 and second section 204 are important, as the diameter of first section 202 must be sufficiently large as to encompass the sharpened portions of the gaff, while not being so large as to interfere with the spur when attached. Similarly, second section 204 must have a diameter large enough to allow second section 204 to be snapped onto leg iron 102, but not so large as to prevent second section 204 from providing a constricting grip on a portion of leg iron 102.

In addition to the diameters of first section 202 and second section 204 being vital to the overall function of gaff guard 200, the respective lengths of first section 202 and second section 204 are also important. For example, the length of first section 202 must be sufficient to enclose gaffs of varying length, as well as to provide a suitable hand-hold for attaching and/or detaching the gaff guard 200 from the spur 100. The first section 202 shown in FIGS. 7-9 has a length of 79 mm, measured from an open end 205 to an interior-facing end 216. However, it is to be understood that the length of first section 202 could be longer or shorter than that which is shown in FIGS. 7-9. For example, first section 202 could be in the range of 50-100 mm in length and still provide suitable coverage for many commercially-known gaffs. As noted above, gaff length is generally dependent upon the industry in which the spur is used, with utility workers often utilizing shorter gaffs, and arborists climbing trees having thick bark often utilizing longer gaffs. Due to both its extended length and its constant diameter along that length, first section 202 is capable of sufficiently covering gaffs of varying dimensions.

Additionally, the length of second section 204 is also important for several reasons. One such reason is that a longer second section 204 provides the user with a greater surface area to push or pull when installing or removing the gaff guard 200. This greater surface area is particularly useful when the user only has one hand available to install or remove gaff guard 200. Another reason is that a longer second section 204 adds resiliency to the overall guard 200, as a shorter second section 204 may reduce the strength of the constricting grip on leg iron 102, possibly leading to inadvertent removal of gaff guard 200 during transport, etc. In the examples shown in FIGS. 7-9, the length of second section 204 measured between open end 206 and respective interior-facing end surfaces 212, 213 is 41 mm. However, it is also to be understood that the length of second section 204 could be longer or shorter, dependent upon the application, the gaff length, the spur model, etc. For example, second section 204 could be in the range of 25-60 mm in length.

Another key dimension for optimal operation of gaff guard 200 is the width of opening 207 between respective end surfaces 210, 211 of second section 204. The width of opening 207, like the diameter of second section 204, must be large enough to allow second section 204 to be snapped onto leg iron 102, but not so large as to prevent second section 204 from providing a constricting grip on a portion of leg iron 102. In the example shown in FIGS. 7-9, the width of opening 207 between respective end surfaces 210, 211 is 30 mm. However, it is to be understood that the width of opening 207 may be larger or smaller, for example, in the range between about 20-40 mm. Furthermore, the user may also customize the width of opening 207. For example, the user may manually file down or cut the respective end surfaces 210, 211 to form a wider opening 207 in the event that they are utilizing a spur having a wider leg iron 102, or if they simply wish to refine the level of resistance required to install and/or detach the gaff guard 200 to/from the spur 100.

The dimensions of cut-out section 208 in tapered section 209 are also important to the overall function of gaff guard 200. Cut-out section 208 provides a space for a portion of the leg iron 102 to pass into the gaff guard 200 at or near the attachment point of the gaff 114. Thus, it is imperative that the cut-out section be both sufficiently long and deep so as to provide adequate space for leg iron 102 to pass therethrough. In the example shown in FIGS. 7-9, the length of cut-out section 208 along respective walls 214, 215, as measured between interior-facing end surface 216 of first portion and interior-facing end surfaces 212, 213 of second portion 204, is 35 mm. Again, however, the length of cut-out section 208 could be longer or shorter, e.g., in the range of about 25 mm to 50 mm. The depth of cut-out section 208, as shown in FIGS. 7-9, is 16 mm along respective end interior-facing end surfaces 212, 213, and 13 mm along interior-facing end surface 216. Once again, the depth of cut-out section 208 could be more or less, e.g., in the range of 10 mm to 20 mm.

Figure 10:
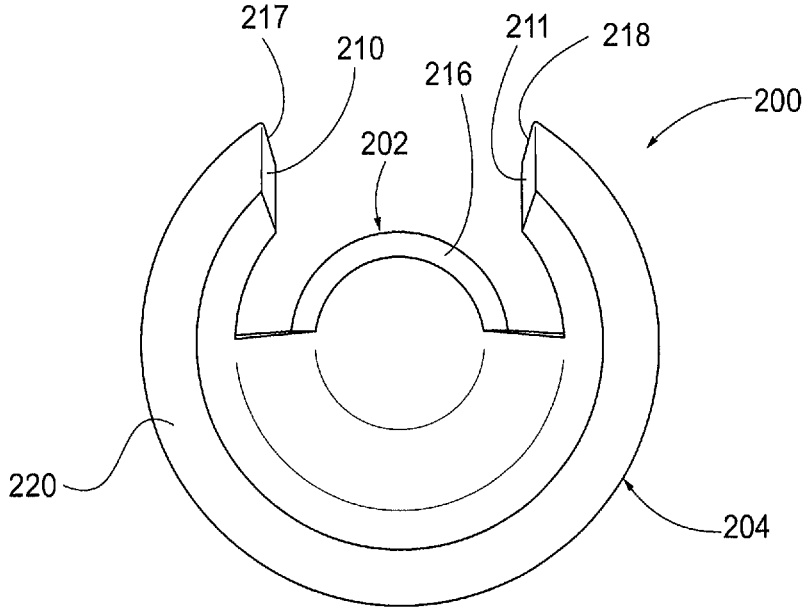
FIG. 10 is an end view of the gaff guard of FIG. 7.

Next, referring to FIG. 10, an end view of gaff guard 200 is shown. FIG. 10 illustrates the discernable variation in diameter between the first section 202 and the second section 204. Additionally, the respective sidewall thicknesses of first section 202 and second section 204 are also shown to be markedly different. First section 202, at interior-facing end surface 216, is shown having a thickness of about 3 mm, while second section 204, at an end surface 220, is shown having a thickness of about 5 mm. This variation in sidewall thickness between first section 202 and second section 204 adds to the optimal operation of gaff guard 200. As first section 202 does not need to be both flexible and resilient, sidewall thickness is not of particular concern, so long as first section 202 adequately provides for protection of gaff 114 and does not unduly wear due to repeated installation and removal. However, second section 204 needs to be both flexible and resilient such that it can be snapped and held onto a leg iron 102 of a spur 100. If the sidewall thickness of second section 204 were too thin, the second section 204 would be flexible, but would lack the resiliency required for repeated installation and removal of the gaff guard 200. Conversely, if the sidewall thickness of second section 204 were too thick, the second section 204 would be suitably resilient, but would lack the flexibility necessary for installation and removal of the gaff guard 200.

Referring still to FIG. 10, respective end surfaces 210, 211 of second section 204 are shown as having respective rounded or chamfered edges 217, 218 on outer regions thereof. Rounded or chamfered edges 217, 218 are provided so as to aid the second section 204 in snapping onto the leg iron 102 during installation of the gaff guard 200, as the rounded or chamfered edges 217, 218 reduce the resistance of the second section 204 when pushed against a surface of leg iron 102. Similar rounded or chamfered edges may or may not be provided in inner regions of respective end surfaces 210, 211 so as to aid in the removal of second section 204 from leg iron 102.

Figure 11:
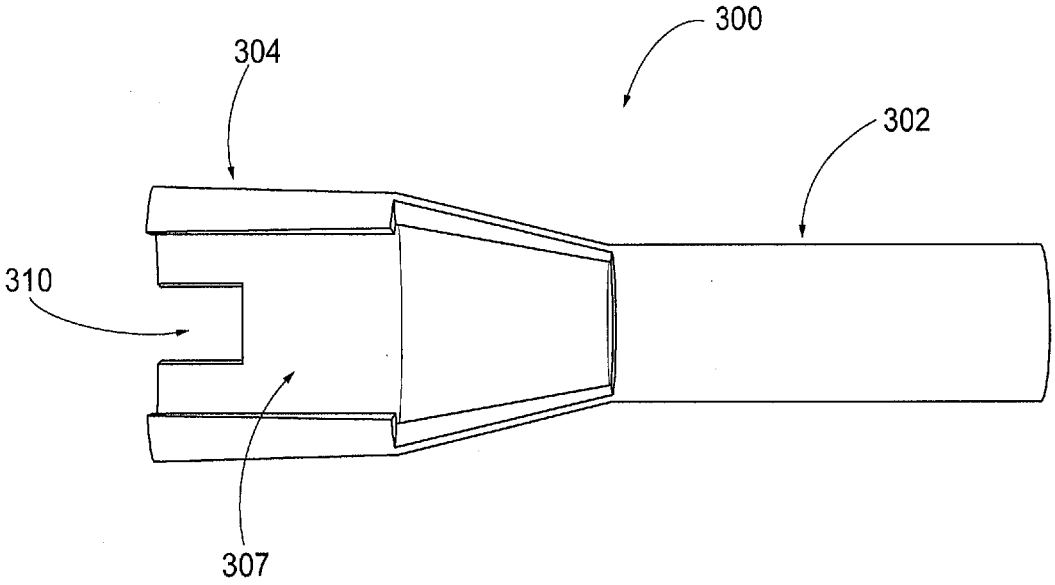
FIG. 11 is a top view of a gaff guard according to another aspect of the present disclosure.

Finally, referring to FIG. 11, a gaff guard 300 in accordance with another aspect of the present disclosure is shown. Gaff guard 300, like gaff guard 200 described above, comprises first section 302 and a second section 304. Second section 304 further comprises an opening 307 formed therein, wherein opening 307 allows for second section 304 of gaff guard 300 to be snapped onto a leg iron or other portion of a spur. However, second section 304 also further comprises an indentation or notch 310 on a side opposite that of opening 307. Notch 310 allows for greater range of motion and/or pivotability of gaff guard 300 when installing or removing gaff guard 300 on a spur. That is, when the user wishes to install gaff guard 300, the notch 310 provides added clearance for pivoting and/or twisting second section 304 into place such that, it snaps onto a portion of the spur. Similarly, when the user wishes to remove the gaff guard 300, notch 310 may provide added clearance for pivoting and/or twisting second section 304 so as to disconnect the second section 304 from the spur. The addition of notch 310, while removing material from second section 304, does not alter the protection provided over a gaff by the first section 302.

The preferred aspects of the invention have been described in detail herein. However, it will be appreciated by those skilled in the art that various modifications and alternatives to the preferred aspects may be made to the invention without departing from the concepts disclosed in the foregoing description. Such modifications are to be considered as included within the following claims unless the claims, by their language, expressly state otherwise. Accordingly, the particular aspects described in detail hereinabove are illustrative only and are not limiting as to the scope of the invention, which is to be given the full breadth of the appended claims and any and all equivalents thereof.

The invention claimed is:

1. A gaff guard for substantially covering a gaff extending from a climbing spur, the gaff guard comprising:

a first cylindrical section having a first diameter, the first section being configured to surround the gaff;

a second partially cylindrical section having a second diameter, the second section having an elongated opening extending along a length thereof, wherein the second section is configured to partially surround and releasably engage the climbing spur; and a tapered section disposed between and connecting the first section and the second section, wherein the tapered section comprises a cut-out extending therethrough, the cut-out being configured to allow the climbing spur to pass through the tapered section from an interior of the second section to an exterior of the first section when the gaff is positioned within an interior of the first section, wherein the second diameter of the second section is greater than the first diameter of the first section, wherein the tapered section has a tapering partially cylindrical shape with a diameter at one end thereof equal to the second diameter of the second section and a diameter at an opposing end thereof equal to the first diameter of the first section, wherein the first diameter of the first section is constant along a length of the first section, wherein the elongated opening of the second section is defined by a pair of opposing end surfaces extending along the length of the second section, the opposing end surfaces being spaced apart by a width between 20 mm to 40 mm, and wherein the first section defines an open end of the gaff guard configured to allow dirt and debris to exit the interior of the first section.

2. The gaff guard according to claim 1, wherein the first section, the second section, and the tapered section are monolithically formed.

3. The gaff guard according to claim 1, wherein the gaff guard is formed from a thermoplastic material.

4. The gaff guard according to claim 3, wherein the thermoplastic material is acrylonitrile-butadiene-styrene (ABS).

5. The gaff guard according to claim 1, wherein the pair of opposing end surfaces of the second section each comprise a rounded or chamfered edge on an outer portion thereof.

6. The gaff guard according to claim 1, wherein the second diameter of the second section is constant along the length of the second section.

7. The gaff guard according to claim 6, wherein the first diameter of the first section is between 15 mm to 25 mm.

8. The gaff guard according to claim 6, wherein the second diameter of the second section is between 40 mm to 50 mm.

9. The gaff guard according to claim 1, wherein the first section has a length of between 50 mm to 100 mm.

10. The gaff guard according to claim 1, wherein the second section has a material thickness greater than a material thickness of the first section.

11. The gaff guard according to claim 1, wherein the second section further comprises a notch formed on a surface thereof opposite to the elongated opening.

12. A gaff guard for substantially covering a gaff extending from a climbing spur, the gaff guard comprising:

a first cylindrical section having a first diameter, the first section being configured to surround the gaff;

a second partially cylindrical section having a second diameter, the second section having an elongated opening extending along a length thereof, wherein the second section is configured to partially surround and releasably engage the climbing spur; and a tapered section disposed between and connecting the first section and the second section, wherein the tapered section comprises a cut-out extending therethrough, the cut-out being configured to allow the climbing spur to pass through the tapered section from an interior of the second section to an exterior of the first section when the gaff is positioned within an interior of the first section, wherein the second diameter of the second section is greater than the first diameter of the first section, wherein the tapered section has a tapering partially cylindrical shape with a diameter at one end thereof equal to the second diameter of the second section and a diameter at an opposing end thereof equal to the first diameter of the first section, wherein the first diameter of the first section is constant along a length of the first section and the second diameter of the second section is constant along the length of the second section, and wherein the first section defines an open end of the gaff guard configured to allow dirt and debris to exit the interior of the first section.

13. The gaff guard according to claim 12, wherein the elongated opening of the second section is defined by a pair of opposing end surfaces extending along the length of the second section.

14. The gaff guard according to claim 13, wherein the pair of opposing end surfaces of the second section each comprise a rounded or chamfered edge on an outer portion thereof.

15. The gaff guard according to claim 12, wherein the second section has a material thickness greater than a material thickness of the first section.

16. A gaff guard for substantially covering a gaff extending from a climbing spur, the gaff guard comprising:

a first cylindrical section having a first diameter, the first section being configured to surround the gaff;

a second partially cylindrical section having a second diameter, the second section having an elongated opening extending along a length thereof, wherein the second section is configured to partially surround and releasably engage the climbing spur; and a tapered section disposed between and connecting the first section and the second section, wherein the tapered section comprises a cut-out extending therethrough, the cut-out being configured to allow the climbing spur to pass through the tapered section from an interior of the second section to an exterior of the first section when the gaff is positioned within an interior of the first section, wherein the second diameter of the second section is greater than the first diameter of the first section, wherein the tapered section has a tapering partially cylindrical shape with a diameter at one end thereof equal to the second diameter of the second section and a diameter at an opposing end thereof equal to the first diameter of the first section, wherein the first diameter of the first section is constant along a length of the first section, and wherein the first section defines an open end of the gaff guard configured to allow dirt and debris to exit the interior of the first section.

17. The gaff guard according to claim 16, wherein the elongated opening of the second section is defined by a pair of opposing end surfaces extending along the length of the second section.

18. The gaff guard according to claim 17, wherein the pair of opposing end surfaces of the second section each comprise a rounded or chamfered edge on an outer portion thereof.

19. The gaff guard according to claim 16, wherein the second section has a material thickness greater than a material thickness of the first section.

* * * * *